US005953437A

United States Patent [19]

Imahori et al.

[11] Patent Number: 5,953,437

[45] Date of Patent: Sep. 14, 1999

[54] ELECTROACOUSTIC TRANSDUCER

[75] Inventors: Yoshio Imahori; Isao Fushimi; Naoyuki Kigawa; Kazushige Tajima; Kazushi Suzuki, all of Shizuoka, Japan

[73] Assignee: Star Micronics Co., Ltd., Shizuoka, Japan

[21] Appl. No.: 08/956,341

[22] Filed: Oct. 23, 1997

[30] Foreign Application Priority Data

Oct. 28, 1996 [JP] Japan ..... 8-285160

[51] Int. Cl.[6] ..... H04R 25/00

[52] U.S. Cl. ..... 381/417; 381/412

[58] Field of Search ..... 381/192, 193, 381/191, 202, 200, 396, 398, 399, 412, 417, 386, 409; 367/175

[56] References Cited

U.S. PATENT DOCUMENTS 5,432,758 7/1995 Sone ..... 381/202

5,467,323 11/1995 Sone ..... 381/193

5,581,623 12/1996 Ishimura et al. ..... 381/396

*Primary Examiner*—Huyen Le

*Attorney, Agent, or Firm*—Pollock, Vande Sande & Amernick

[57] ABSTRACT

The invention provides a miniaturized and low-profile electroacoustic transducer. In the electroacoustic transducer, a space is formed underneath a magnet by diminishing a vertical thickness of the magnet in comparison with the height of a magnetic core, and also by disposing the magnet at a position trensversely aligned to an upper portion of the magnetic core, so that the space is utilized as a part of a back space at the back of a diaphragm, and for connection of terminals of a coil with external terminals, thereby realizing miniaturization and flattening in the shape of the electroacoustic transducer.

5 Claims, 12 Drawing Sheets

ELECTROACOUSTIC TRANSDUCER

BACKGROUND OF THE INVENTION

1. Field of the Invention

The present invention relates to an electroacoustic transducer for converting electric signals into sound through electromagnetic conversion.

2. Description of the Related Art

FIGS. 20 and 21 show a typical internal structure of a conventional electroacoustic transducer. The elctroacoustic transducer is provided with a casing 104 consisting of an upper case 100 and a lower case 102. The lower case 102 is provided with a step 106 for supporting a diaphragm 108 in such a way as to cover the lower edge of the upper case 100. The diaphragm 108 is made of a magnetic material, and provided with a magnetic piece 110 as a weight at the center thereof.

The lower case 102 is provided with a base 112, constituting a portion of a yoke and forming a laminate structure together with a bottom plate 114, and a magnetic core 116 is set up upright at the center of the base 112 in such a way as to penetrate through the bottom plate 114. Between the magnetic core 116 and the diaphragm 108, a gap 118 is provided. A coil 120 is wound around the magnetic core 116, and a length of a portion of the magnetic core 116, wound around with the coil 120, is slightly short of the uppermost end of the magnetic core 116, thereby exposing a portion of the magnetic core 116 above the coil 120. An annular magnet 122 is installed around the periphery of the coil 120 with a space provided therebetween. Further, terminals of the coil 120 are extended outside the casing 104 through through-holes 128, and connected to bar-shaped terminals 124, 126, provided on the bottom plate 114 in a projecting manner, by means of soldering on the underside of the bottom plate 114. The through-holes 128 are filled up with insulating resin for providing insulation, protection, securement of the terminals of the coil, and sealing.

A resonance chamber 130 surrounded by the upper case 100 is formed on the upper side of the diaphragm 108, and open to the air through a sound emitting hole 134 of a sound emitting cylinder 132 formed on the topwall of the upper case 100.

In the electroacoustic transducer described above, a magnetic circuit is set up by the base 112, the magnetic core 116, the diaphragm 108, and the magnet 122. A static magnetic field, caused by the magnet 122 acts on the diaphragm 108, and the magnetized diaphragm 108 is attracted towards the magnetic core 116. In other words, the magnet 122 is caused to act on the diaphragm 108 as a bias magnetic field. When electric signals such as a–c, pulse, or the like are applied between the terminals 124 and 126 against a magnetic field in one direction caused by the static magnetic field as described above, signal current flows in the coil 120, generating an alternating magnetic field in the magnetic core 116, according to the electric signals. The diaphragm 108 is caused to deflect in a direction away from the magnetic core 116 during a period when the direction of the alternating magnetic filed is opposite to that of the static magnetic field of the magnet 122 while same is attracted towards the magnetic core 116 during a period when the direction of the alternating magnetic filed is the same as that for the static magnetic field. Such mechanical movement of the diaphragm 108 up and down as described above is dependent on frequency of the electric signals, and consequently, the diaphragm 108 is vibrated, causing the air to be vibrated. Such vibration of the air is amplified in the resonance chamber 130 in the form of sympathetic vibration (resonance) acoustic waves. The acoustic waves are emitted to the outside mainly through the sound emitting hole 134.

With reference to the elctroacoustic transducer described above, problems to be solved are cited as follows:

(1) Due to a long distance between the coil 120 and the terminals 124, 126, and exposure of the connecting portion of the terminals of the coil 120 on the underside of the casing 104, the exposed terminals of the coil are susceptible to damage, creating a cause for accidental breaks of wiring. As a result, protective measures such as coating with insulating resin, or the like were required.

(2) As a connecting means for the terminals of the coil is provided outside of the casing 104, the thickness of the electroacoustic transducer, in the direction of its height, increased, preventing the electroacoustic transducer from being rendered thinner or miniaturized.

(3) In some of the electroacoustic transducer, a space is provided by cutting a notch in part of the annular magnet such that connection of the terminals of the coil with the terminals 124,126, can be made inside the casing 104. However, it is not easy to machine the magnet 122, and moreover, providing a notch severing a magnetic path in part of the magnet 122 results in lowering of magnetic attraction between the magnet 122 and the diaphragm 108. Further, a force to support the diaphragm 108 by the notched portion of the magnet 122 is partly reduced. Thus, machining the magnet 122 leads to an increase in the cost of manufacturing the electroacoustic transducer by the cost of such machining, and to partial reduction in the force to support the diaphragm 108, that is, partial change in the rigidity of the diaphragm 108, resulting in unstable vibration and consequently, degradation in the quality of sound.

(4) The height of the coil 120 is substantially equal to that of the magnet 122, and the height of the magnet has been a stumbling block for miniaturization and flattening of the electroacoustic transducer. Magnetic force generated by a coil is generally dependent on input electric current and the number of turns of a winding. The magnetic force of the magnet is very strong in comparison with that generated by the coil but this requires a relatinely large magnet.

SUMMARY OF THE INVENTION

It is therefore an object of the present invention to provide an electroacoustic transducer successfully miniaturized and flattened in its height.

As illustrated in FIGS. 1 to 19 by way of example, in the electroacoustic transducer according to the invention, a space 38 is formed underneath a magnet 22 by reducing the thickness of the magnet 22 in the direction of the height thereof in comparison with the length of a magnetic core 16 as well as by disposing the magnet 22 at a position tranoversely aligned with the upper portion of the magnetic core 16. Thus the space 38 is utilized as a part of a back space 23 at the back of a diaphragm 20, and for connection of terminals 19, 21 of a coil with external terminals (terminals 10, 12), and the like. This result in miniaturization and flattening of the electroacoustic transducer.

More specifically, in the electroacoustic transducer according to the invention, electric signals are converted into acoustic waves by causing a static magnetic field to act on the diaphragm 20 made of a magnetic material, and also by causing an alternating magnetic field generated by the electric signals to act on the diaphragm. It comprises the magnetic core 16 installed with a gap 34 provided with respect to the diaphragm 20, the coil 18 is wound around the magnetic core 16 for generating the alternating magnetic field upon receiving the electric signals, and the magnet 22 is installed in such a way as to surround the coil 18 and at a position aligned with the upper portion of the magnetic core 16, and the vertical thickness of which is set to be less than the height of the magnetic core 16. In the case of the magnet being made of a currently available magnetic material, magnetic force thereof can be rendered stronger than that generated by the coil. Accordingly, it is possible to set the thickness of the magnet thinner in comparison with the length of the coil or same of the magnetic core. Consequently, a space can be provided underneath the magnet such that the space is utilized for enlargement of the volume of the back space at the back of the diaphragm, and the like, contributing to reinforcement of sound pressure as well as creating the magnet in low profile. This enables fabrication of a miniaturized and low-profile model of the electroacoustic transducer.

Thus, the electroacoustic transducer according to the invention features formation of the space underneath the magnet, constituting a part of the back space at the back of the diaphragm. The space formed underneath the magnet is utilized as a part of the back space at the back of the diaphragm, contributing to enlargement of the back vibrating space. As the back space is enlarged, pressure on the diaphragm during vibration can be diminished, enabling a smooth vibration of the diaphragm contributing to enhancement of sound pressure output and leveling off of frequency characteristics.

Further, the electroacoustic transducer according to the invention features provision of a connection of the external terminals for receiving the electric signals with the terminals of the coil at the back of the magnet. By providing the connection of the external terminals with the terminals of the coil within the space formed underneath the magnet, the connection of the external terminals with the terminals of the coil can be stowed inside the casing so that the electroacoustic transducer can be miniaturized and flattened in profile. In particular, by disposing terminals adapted for surface mounting outside the space, flattening and miniaturization of the electroacoustic transducer is facilitated.

Still further, the electroacoustic transducer according to the invention features the magnet being supported by the casing or holding members provided inside the casing. By use of the casing or the holding members provided inside the casing as a means for installing the magnet at a position transversely aligned with the upper portion of the magnetic core, the magnet can be installed, and secured at a desired position.

Even further, the electroacoustic transducer according to the invention features use of a magnet, the thickness thereof in the direction of the diameter of the magnetic core being set large, for the magnet. In case that a problem of drop in magnetic force arises due to use of a low-profile magnet, such a problem is compensated for by increasing the thickness of the magnet in the direction of the diameter thereof. The magnetic force of the magnet may also be set at a desired strength by adjusting the thickness in such a way.

The above and other objects, features and advantages of the invention will become more apparent by referring to the following detailed description of embodiments and drawings.

DETAILED DESCRIPTION OF THE PREFERRED EMBODIMENTS

Referring to the accompanying drawings, an electroacoustic transducer according to an embodiment of the invention is described in detail hereinafter.

Figure 1:
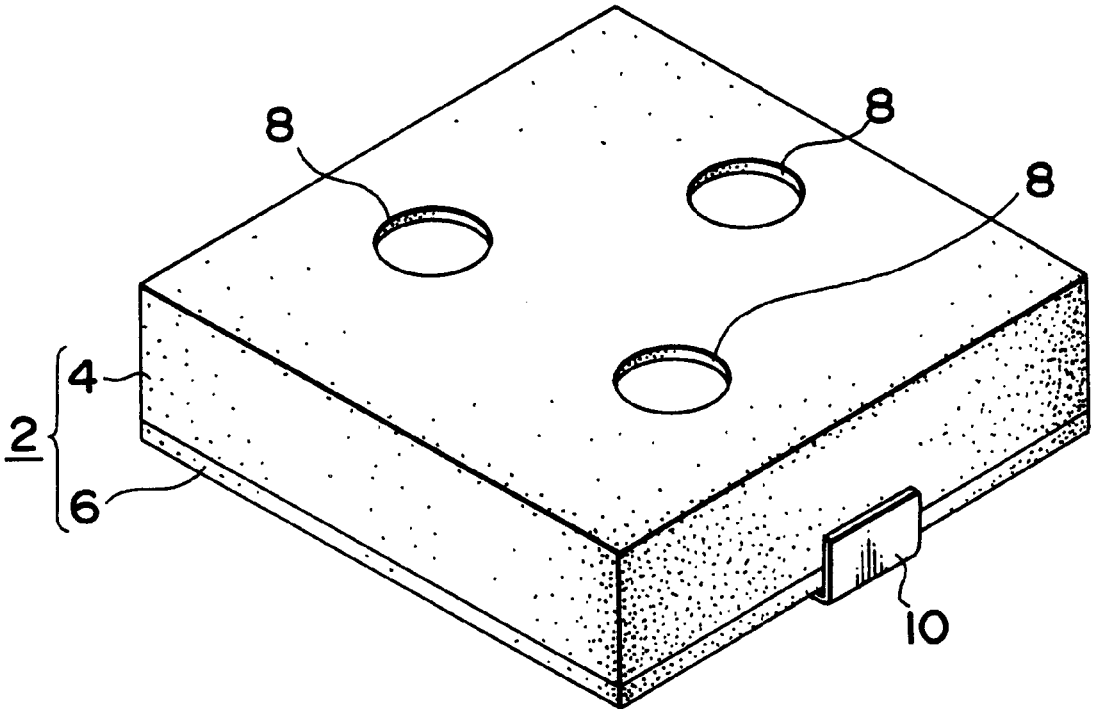
FIG. 1 is a perspective view of an electroacoustic transducer according to an embodiment of the invention.

FIG. 1 illustrates the electroacoustic transducer according to the embodiment of the invention. The electroacoustic transducer is composed of a casing 2 in the shape of a low-profile square box comprising a square box case 4 and a base portion 6 serving as a lid for the case 4. The case 4 and the base portion 6 are made of, for example, thermoplastic resin. A plurality of sound emitting holes 8 are formed on the upper surface of the case 4, and a plate shaped terminal 10 is projected from the base portion 6. The terminal 10 is bent along a sidewall of the case 4, in a form resembling the letter L, for electrical connection with a conductor pattern on a printed circuit board by means of soldering, or the like, constituting a terminal adapted for so-called surface mounting. A terminal 12 (FIG. 2) in the shape identical to that of the terminal 10 is formed on the opposite side of the terminal 10.

Figure 2:
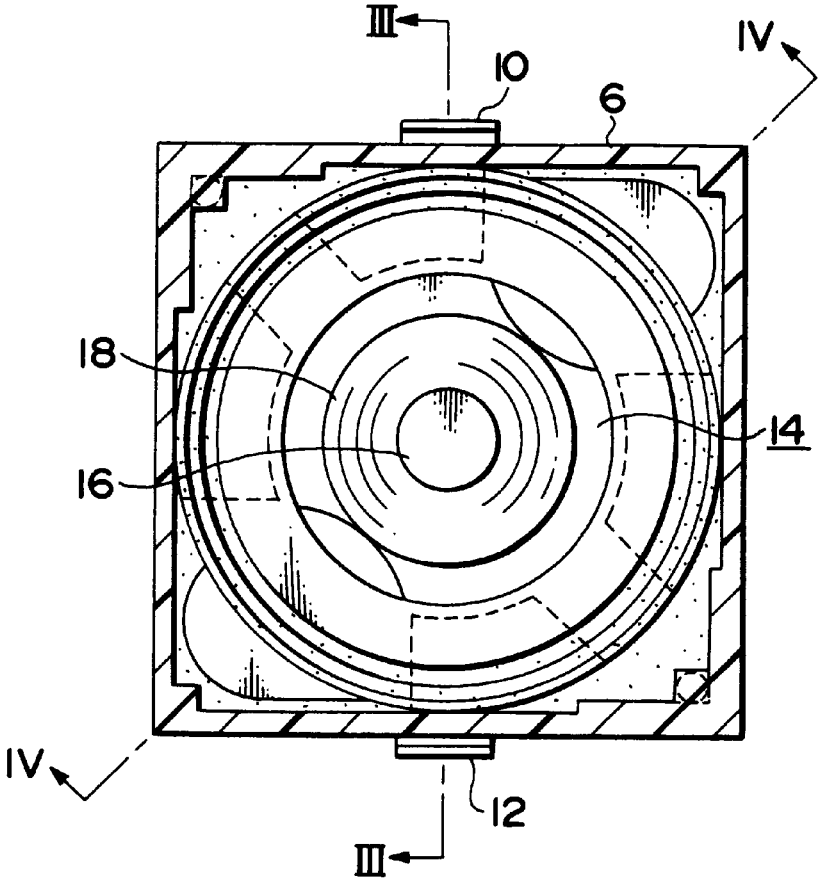
FIG. 2 is a plan view of the electroacoustic transducer with an upper case thereof cut away.
Figure 3:
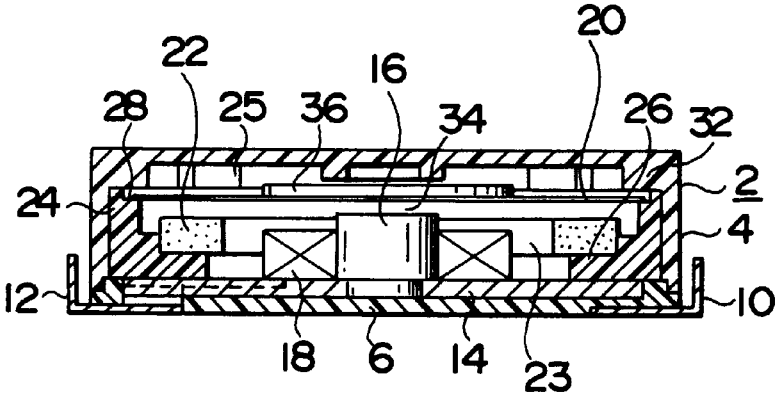
FIG. 3 is a section view taken on line III—III in FIG. 2.
Figure 4:
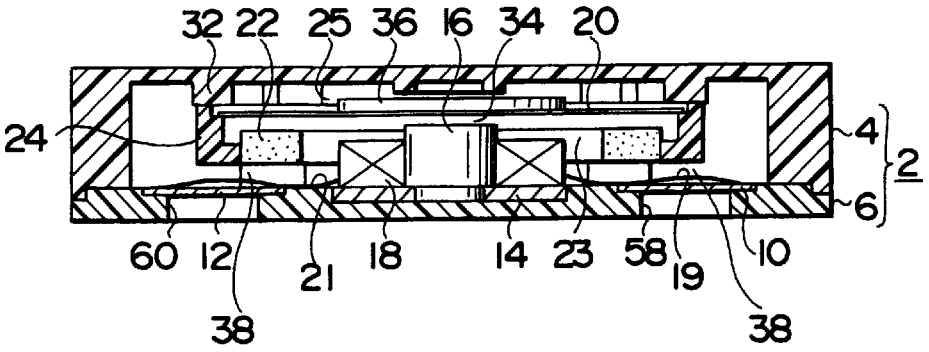
FIG. 4 is a section view taken on line IV—IV in FIG. 2.

FIG. 2 shows the electroacoustic transducer with the ceiling of the casing 2 cut away. FIG. 3 is a section view taken on line III—III in FIG. 2, and FIG. 4 a section view taken on line IV—IV in FIG. 2. The base portion 6 is provided with a base 14 insert-molded thereon on the upper surface thereof, and with the terminals 10,12, insert-molded thereon on the back surface thereof. The base 14 is made of a magnetic material, and a magnetic core 16 columnar in shape is installed in the center thereof. A coil 18 is wound around the magnetic core 16, and the height of the coil 18 is lower than that of the magnetic core 16, thereby exposing the uppermost end of the magnetic core 16 above the top end of the coil 18.

Further, a holder ring 24 is provided above the upper surface of the base portion 6, serving as a member for holding a diaphragm 20 and a magnet 22, and the holder ring 24 is disposed such that the peripheral surface thereof is inscribed in the internal surface of sidewalls of the case 4. Similarly to the casing 2, the holder ring 24 is made of a synthetic resin, and the magnet 22 annular in shape is supported by holders 26. The position of the circumferential surface of the magnet 22 is defined by the internal circumferential surface of the holder ring 24. Thus, the center of the magnet 22 coincides with that of the magnet core 16. In the embodiment described above, the magnet 22 and the holder ring 24 are integrally molded from the resin, that is, the magnet 22 is insert-molded. Further, the edge of the diaphragm 20 is placed on a holding portion 28 of the holder ring 24, and the case 4 is provided with protrusions 32 as a means for preventing upward movement of the edge of the diaphragm 20. A gap 34 of a predetermined spread is provided between the diaphragm 20 and the uppermost end of the magnet core 16.

A magnet piece 36 in the shape of a disk is attached to the upper surface of the diaphragm 20 as a means for adding to the mass of the diaphragm 20, and the diaphragm 20 is in an attracted state by the agency of a static magnetic field generated by the magnet 20. As a result, the diaphragm 20 being attracted towards the magnet 20 falls into a stationary state. On the underside of the diaphragm 20, a back space 23 is formed, and on the upper surface side thereof, a resonance chamber 25.

Terminals 19 and 21 of the coil are extended over a minimum distance under the magnet 22, that is, into a space 38 underneath the holder ring 24 for connection with the terminals 10 and 12, respectively, by a connecting means such as soldering, or the like so that the former is electrically connected with the latter.

Figure 5:
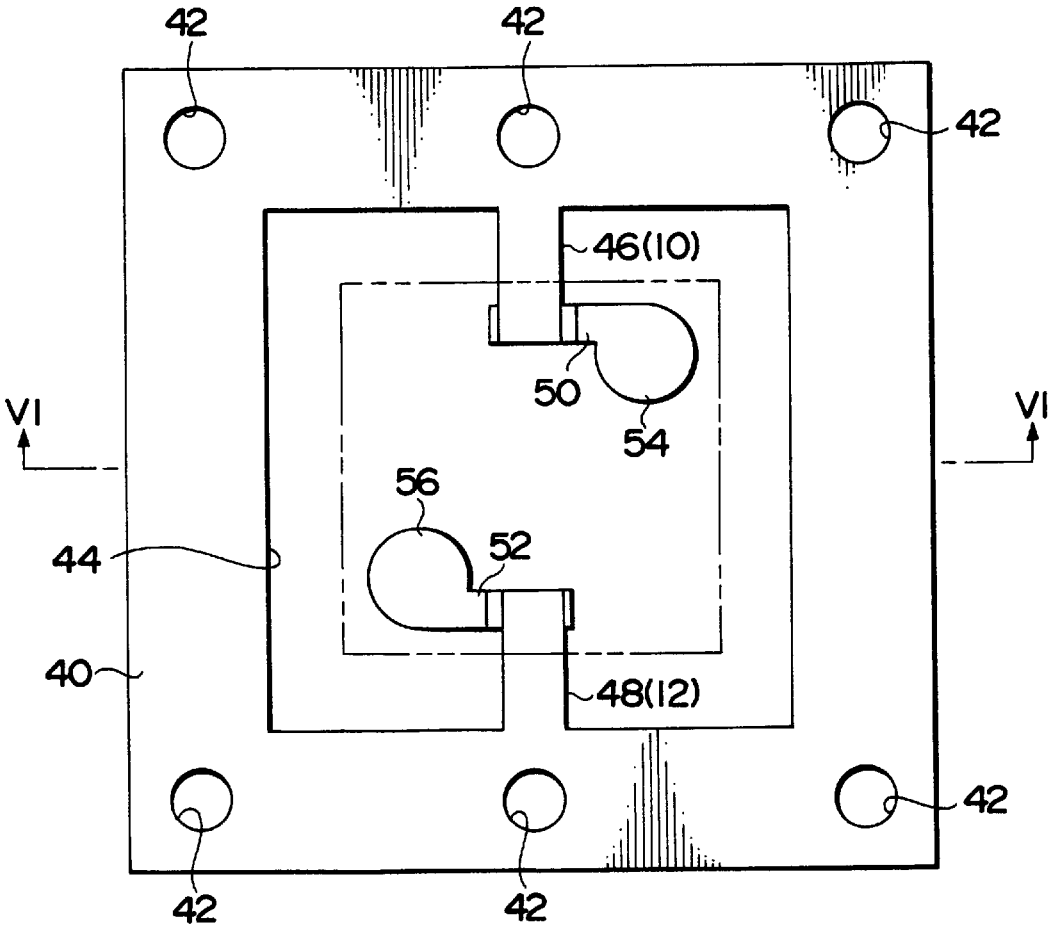
FIG. 5 is a plan view of a lead frame used in fabrication of the electroacoustic transducer.
Figure 6:
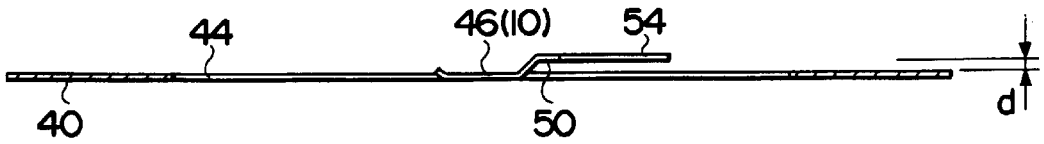
FIG. 6 is a section view taken on line VI—VI in FIG. 5.

Now referring to exploded views of the electroacoustic transducer, respective parts and methods of fabricating same are described hereafter. FIGS. 5 and 6 show a lead frame, and FIG. 6 is a section view taken on line VI—VI in FIG. 5. The lead frame comprises a frame section 40 composed of a frame body provided with a plurality of positioning holes 42 formed thereon, and relative position of a mold against the frame section 40 is set with high precision by inserting pins for positioning the mold into the positioning holes 42 when molding the base portion (not shown). Inside an opening 44 of the frame section 40, lead sections 46 and 48, rectangular in shape, and eventually forming the terminals 10 and 12, respectively, are protruded from the edges of the frame section 40, opposite to each other, and auxiliary lead sections 50 and 52 are formed at the extremities of the lead sections 46 and 48, respectively, so as to form right angles with the direction in which the latter are protruded. Pads 54 and 56, for example, circular in shape, and larger in surface area than the auxiliary lead sections 50 and 52 and are formed at the extremities of the auxiliary lead sections 50 and 52. The auxiliary lead sections 50 and the pad 54 at the lead section 46 are disposed in rotational symmetry with the auxiliary lead sections 52 and the pad 56 at the lead section 48, respectively. The auxiliary lead sections 50 and the pad 54 are on a plane parallel to, but set at a level elevated from the lead section 46, by bending the auxiliary lead sections 50 at a point in close vicinity of the lead section 46. The auxiliary lead sections 52 and the pad 56 are in similar relationship with the lead section 48. This means that a spacing d is formed between the lead sections 46 and 48, and the pads 54 and 56, respectively. In FIG. 5, the base portion 6 is denoted by a dash and double-dotted line.

Figure 7:
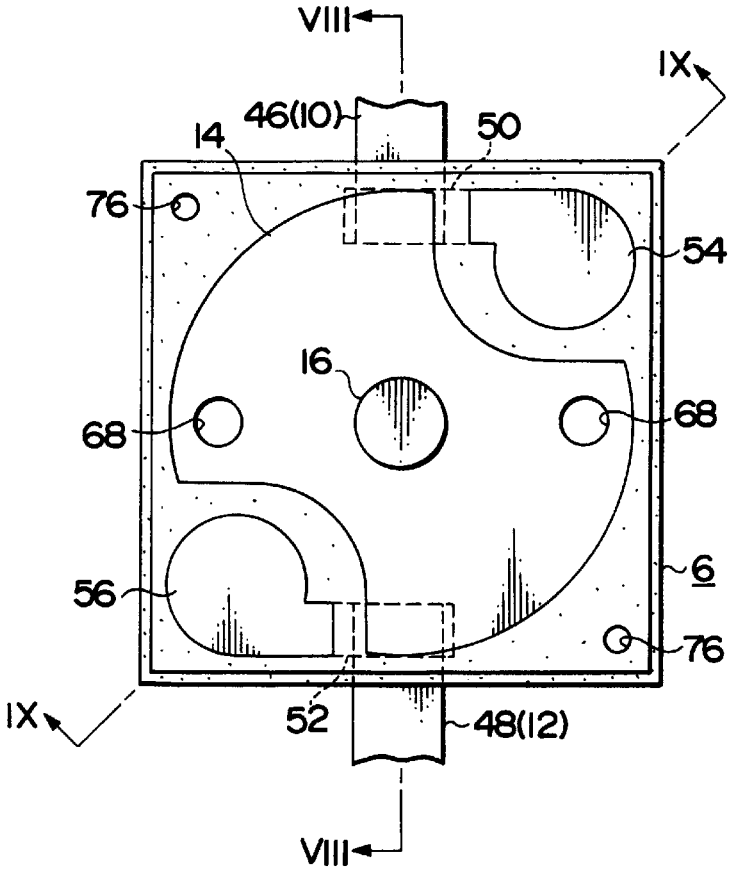
FIG. 7 is a plan view of a base portion formed on the lead frame.
Figure 8:
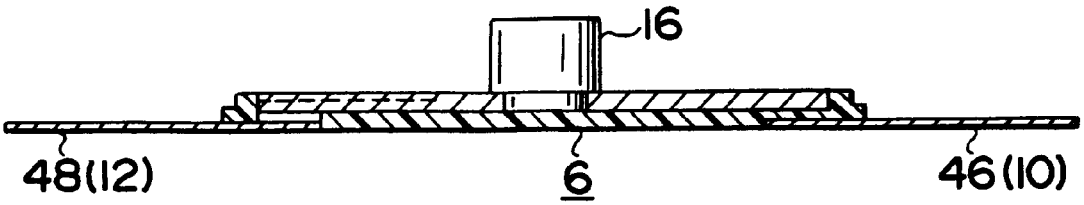
FIG. 8 is a section view taken on line VIII—VIII in FIG. 7.
Figure 9:
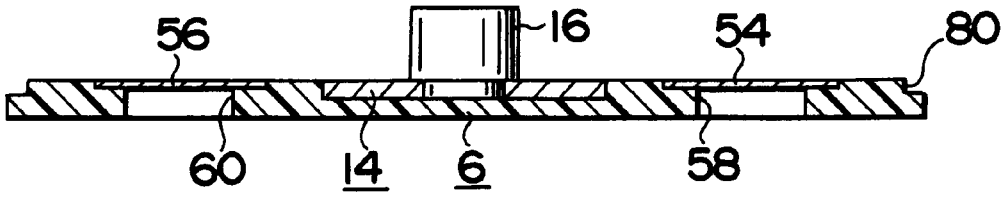
FIG. 9 is a section view taken on line IX—IX in FIG. 7.
Figure 10:
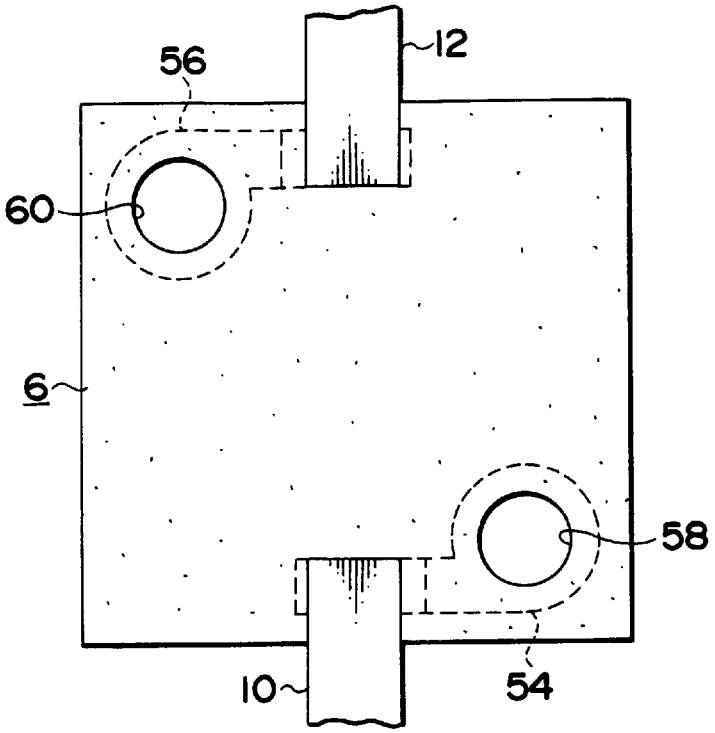
FIG. 10 is a bottom view of the base portion formed on the lead frame.

As shown in FIGS. 7 to 10, the base portion 6 is formed on the lead frame by insert-molding of thermoplastic resin, or the like such that the lead sections 46 and 48, and the pads 54 and 56 of the lead frame are exposed, and a base 14 is attached to the base portion 6. FIG. 7 is a plan view of the base portion 6, FIG. 8 a section view taken on line VIII—VIII in FIG. 7, FIG. 9 is a section view taken on line IX—IX in FIG. 7, and FIG. 10 a bottom view of the base portion 6. The base portion 6 corresponds to the shape of the electroacoustic transducer in the plan view, and is formed to a thickness matching that of the spacing d between the lead sections 46 and 48, and the pads 54 and 56, respectively. As a result, the lead sections 46 and 48 are exposed on the bottom side of the base portion 6 while the pads 54 and 56, and the surface of the base 14 are exposed on the upper surface of the base portion 6. Further, openings 58 and 60 are formed at positions corresponding to the pads 54 and 56, respectively, exposing parts of the pads 54 and 56 out of the openings 58 and 60, respectively, for convenience of soldering.

Figure 11:
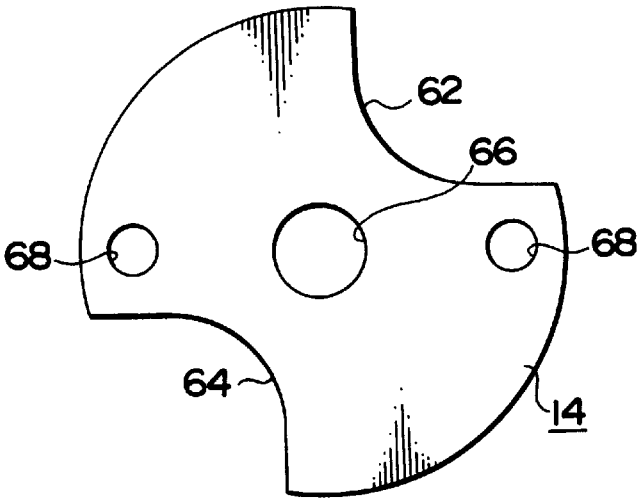
FIG. 11 is a plan view of a base.
Figure 12:
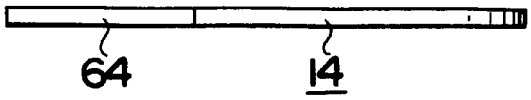
FIG. 12 is a side view of the base.

As shown in FIGS. 11 and 12, the base 14 is formed from a plate shaped magnetic material of a predetermined thickness, and has the shape of a disk provided with indentations 62 and 64, each in the shape of a circular arc. A hole 66 for securing the magnetic core 16 is formed in the center of the base 14, and also through-holes 68 are formed close to the edge thereof, on opposite sides of the hole 66. The respective through-holes 68 can be penetrated with the resin when insert-molding the base 14, thereby securely attaching the base 14 to the base portion 6.

Figure 13:
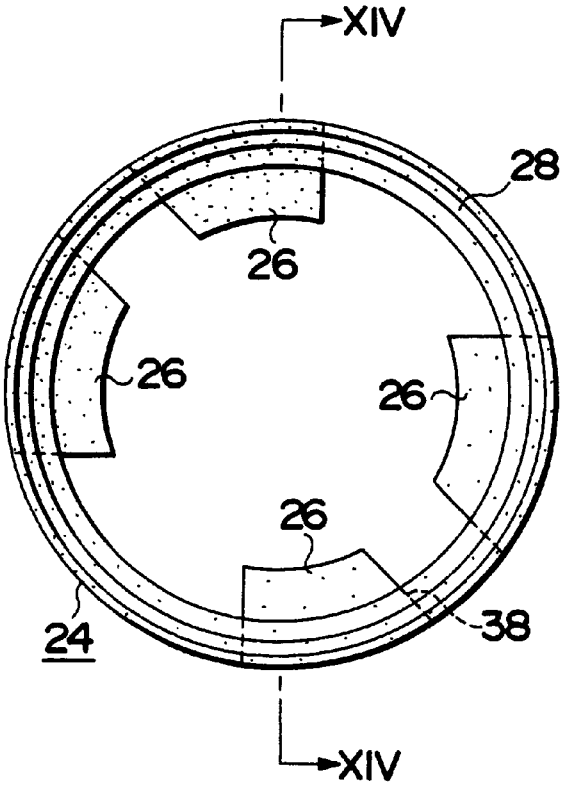
FIG. 13 is a plan view of a holder ring.
Figure 14:
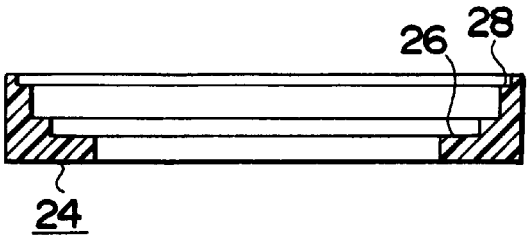
FIG. 14 is a section view taken on line XIV—XIV in FIG. 13.

FIGS. 13 and 14 show the holder ring 24, and FIG. 14 is a section view taken on line XIV—XIV in FIG. 13. The holder ring 24 is provided with the holders 26 for supporting the magnet 22, and the holding portion 28 for supporting the diaphragm 20. The holding portion 28 is circular in shape so as to support uniformly the circumferential edge of the diaphragm 20 while the holders 26 are a plurality of protrusions formed at angular intervals of 90°, serving as legs for supporting the holder ring 24 above the base portion 6. Accordingly, a space is formed between the respective holders 26 and the holding portion 28, and the space 38 formed underneath the holder ring 24 constitutes a part of the back space 23, contributing to enlargement thereof. The volume of the back space 23 can be increased according as respective size of the holders 26, that is, a volume which each occupies in the space is reduced.

Although not shown in the figures, the magnet 22 is insert-molded by molding of the holder ring 24. By use of such a method of molding, joining of the magnet 22 with the holder ring 24 is reinforced, enabling time for fabrication to be shortened owing to reduction in the number of components necessary for fabrication of the electroacoustic transducer.

Figure 15:
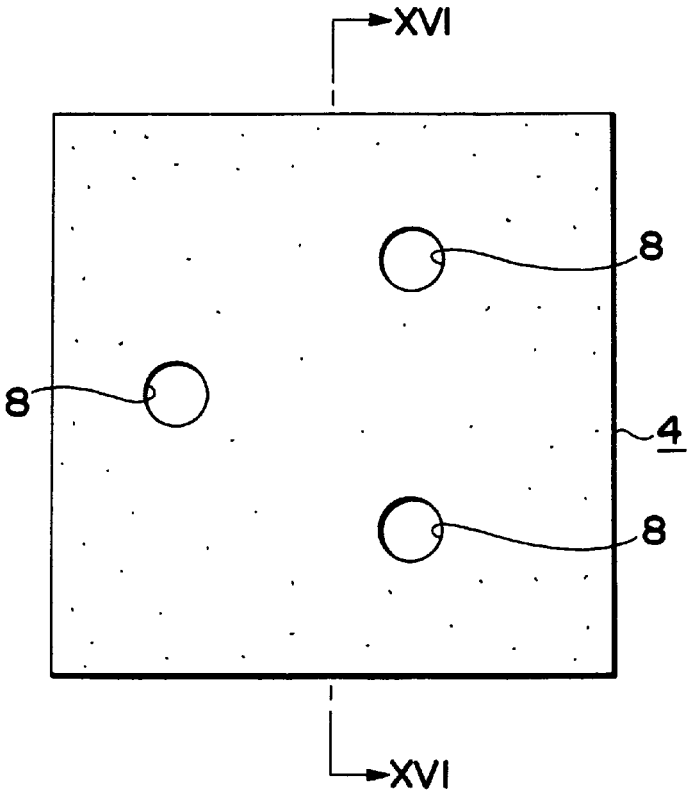
FIG. 15 is a plan view of a case.
Figure 16:
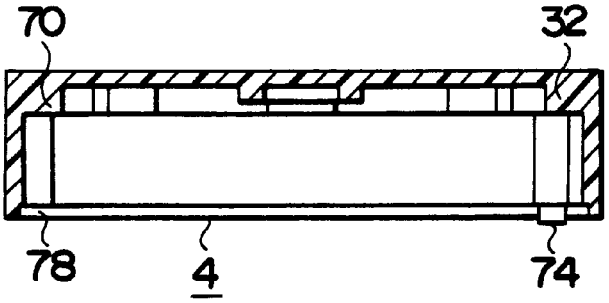
FIG. 16 is a section view taken on line XVI—XVI in FIG. 15.
Figure 17:
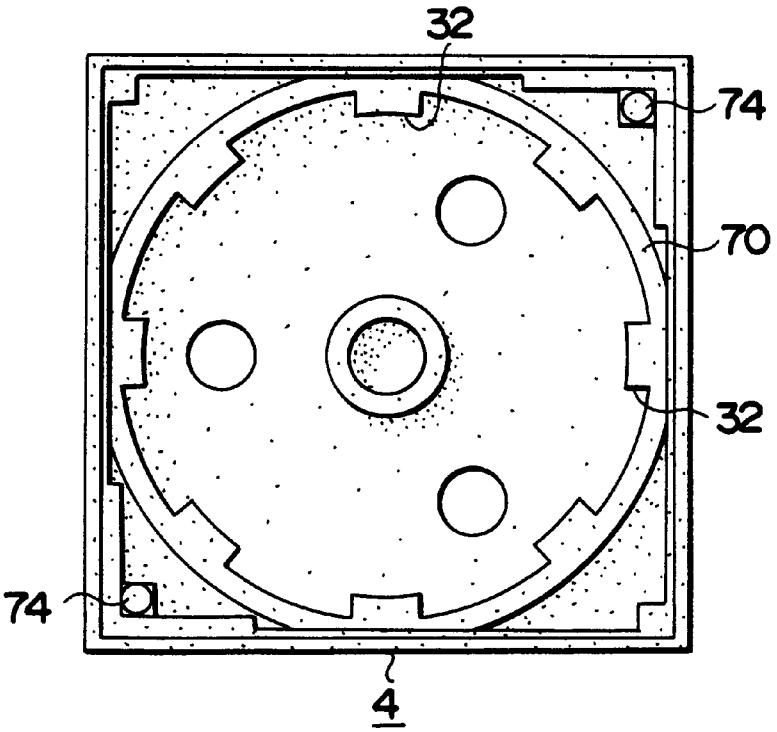
FIG. 17 is a bottom view of the case.

FIGS. 15 to 17 show the case 4 FIG. 15 is a plan view thereof, FIG. 16 a section view taken on line XVI—XVI in FIG. 15, FIG. 17 a bottom view thereof. The case 4 is formed in the shape of a square box with the bottom side thereof open, and a plurality of the sound emitting holes are formed on the upper surface thereof. The ceiling of the case 4 is provided with an annular sidewall 70 corresponding to the diaphragm 20, and a plurality of protrusions 32 projected towards the center from the inner surface of the sidewall 70 are formed at angular intervals of 45° so as to restrain upward movement of the diaphragm 20. A pair of fitting pins 74, disposed along a diagonal line, are protruded from the corners of the ceiling in a square form, and the tip portions thereof are inserted into fitting holes 76 of the base portion 6. Further, an interlocking concave 78 is formed on the open side of the case 4, and an interlocking step 80 of the base portion 6 is inserted therein. Positioning of the case 4 and the base portion 6 is determined by such interlocking relationship, and the both are integrally joined with each other by a binding means such as ultrasonic welding, adhesive, or the like such that binding is rendered secure.

With the electroacoustic transducer constituted as described above, the space 38 is provided between the underside of the magnet 22 and the base 14 or the base portion 6 by reducing the thickness of the magnet 22 in comparison with the height of the magnetic core 16, or the coil 18, and by securing the magnet 22 so as to be transversely aligned with the upper end portion of the magnetic core 16. Thus, the space 38 contributes to enlargement of the back space 23. In addition, a proportion of the volume of the holders 26 of the holder ring 24 to the back space 23 can be lowered by varying the shape of the holders 26, thereby contributing to further enlargement of the back space 23.

As shown in the embodiment of the invention described above, a process of soldering the terminals 10 and 12 for external connection with the terminals 19 and 21 of the coil, that is, connection treatment of these terminals is performed in the space 38 formed by reducing the thickness of the magnet 22, the space 38 serving as a space for stowing electrically connected parts. Furthermore, with the embodiment described above wherein the connected part are stowed in the space 38, only the terminals 10 and 12, each with a flat surface for connection, and serving as external terminals for surface mounting, are exposed on the bottom surface of the base portion 6, achieving simplification of the casing 2 on the bottom side thereof.

Figure 18:
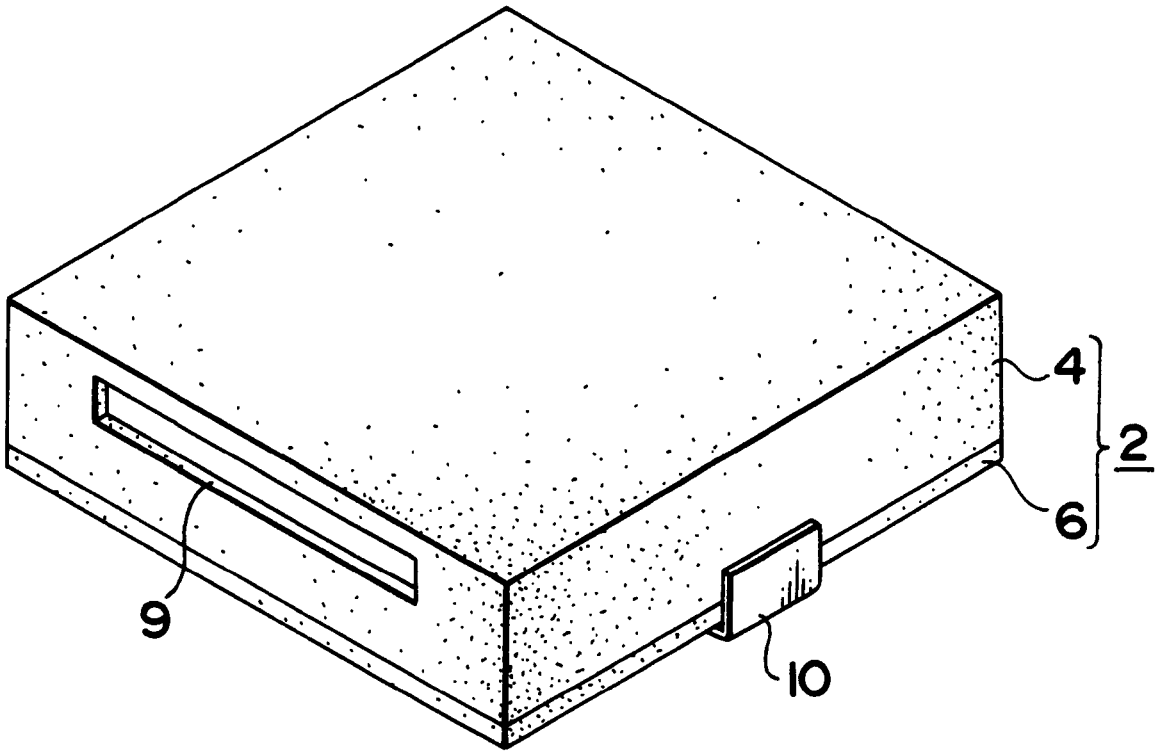
FIG. 18 is a perspective view showing an electroacoustic transducer according to a modification of the embodiment of the invention.

The sound emitting holes 8 of the electroacoustic transducer may be formed at optional spots depending on the direction of sound emission as in the case of a sound emitting hole 9 of a rectangular shape, formed on a sidewall of the case 4, as shown in FIG. 18 by way of example.

Figure 19A:
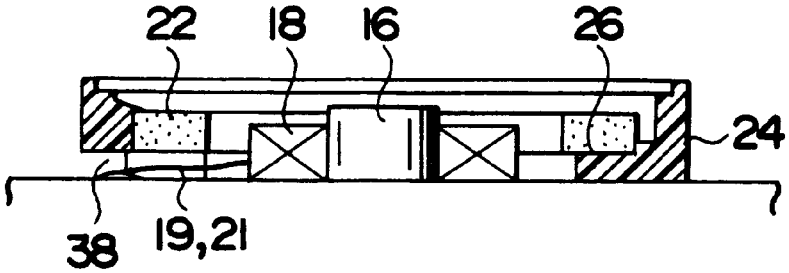
FIGS. 19 A–19 C (hereinafter collectirely referred to as "FIG. 19") are a section view showing various modifications of the holder ring.
Figure 19B:
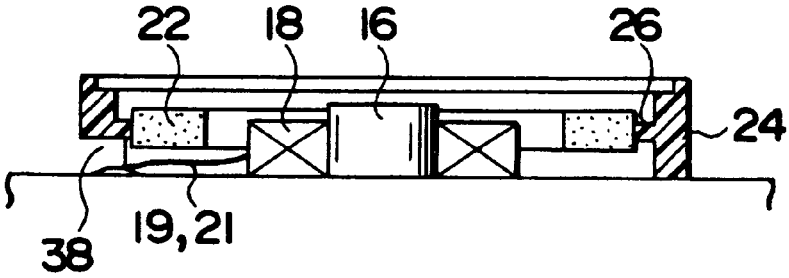
Figure 19C:
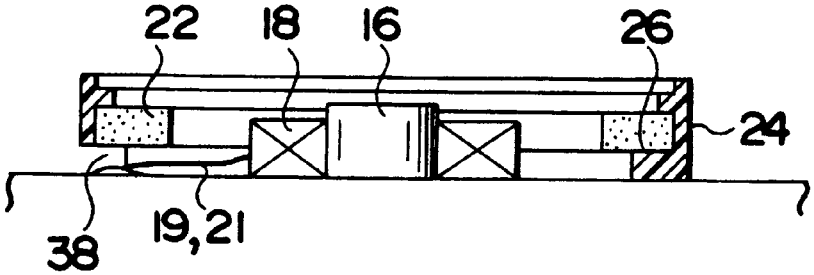
Figure 20:
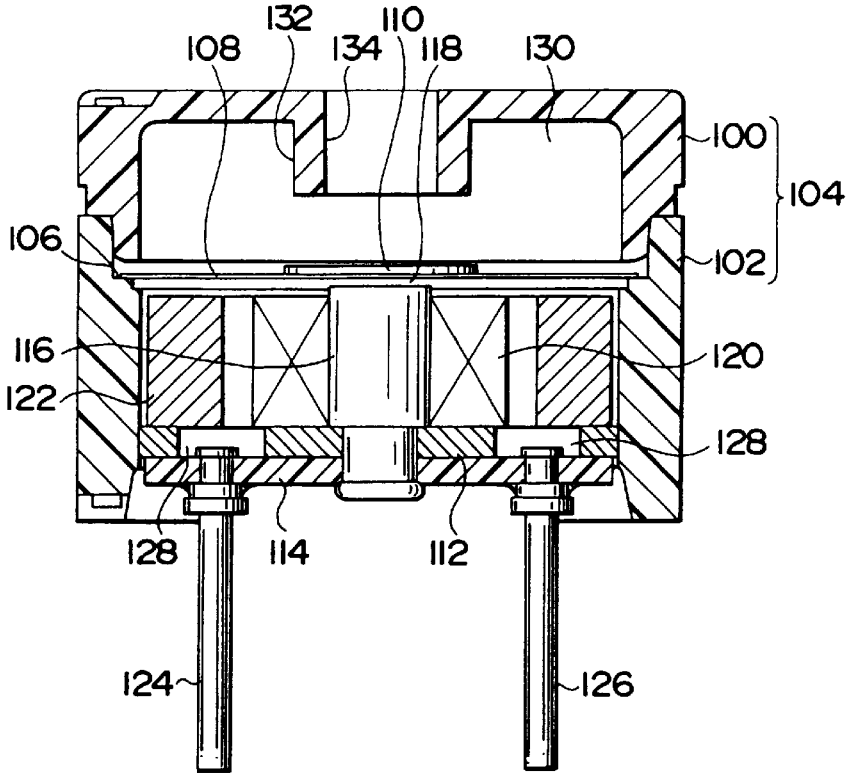
FIG. 20 PRIOR ART
FIG. 20 is a longitudinal section view of a conventional electroacoustic transducer.
Figure 21:
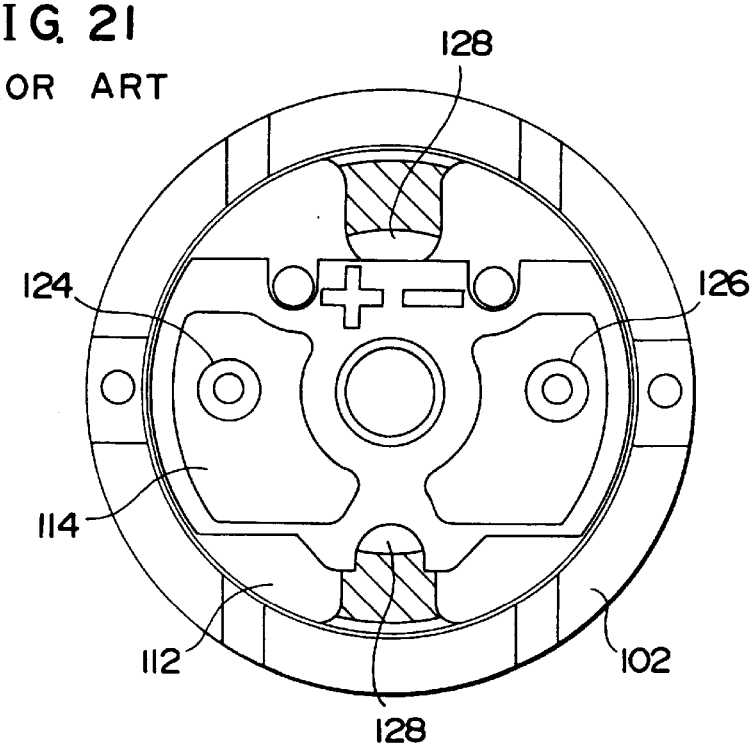
FIG. 21 PRIOR ART
FIG. 21 is a bottom view of the conventional electroacoustic transducer.

The magnet 22 may be securely attached to the holder ring 24 by providing the holder 26 such that the magnet 22 is placed thereon as shown in FIG. 19A, or by providing the holder 26 in the shape of a ring protruding from the inside wall of the holder ring 24 such that the magnet 22 is fixed to the inside thereof as shown in FIG. 19B. By such arrangement, the space 38 having a large volume can be provided underneath the magnet 22, contributing to enlargement of the back space 23, and a space for connection of the terminals 19 and 21 of the coil. As shown in FIG. 19C, the magnet 22 may also be secured by embedding it in the inside wall of the holder ring 24. With such a construction for securing the magnet 22, the thickness of the holder ring 24, in the direction of the diameter thereof, can be reduced taking advantage of a strength of the magnet 22, enabling the dimensions of the electroacoustic transducer to be reduced in the direction of the diameter thereof, and contributing to miniaturization and enlargement of the back space 23. The thickness of the magnet 22 in the direction of its diameter can be set at an optionally increased thickness depending on the diameter of the coil 18 and the inner volume of the casing 2. Increased thickness of the magnet 22 in the direction of its diameter can compensate for reduction in the thickness thereof in the direction of its height. Consequently, sufficient magnetic force can be provided without use of expensive magnetic material in large quantity.

It has been confirmed from results of testing conducted on the electroacoustic transducer according to the invention that even with use of the magnet 22 rendered thinner in thickness, and disposed away from the base 14, sound output and sound pressure, equivalent to those of the conventional electroacoustic transducer, are obtained owing to improvement in the performance of the magnetic material composing the magnet 22.

As described in the foregoing, the effects of the invention are summed up as follows:

a. The invention enables miniaturization and flattening of electroacoustic transducers, and enlargement of the back space at the back of the diaphragm, contributing to enhancement of sound pressure output and leveling off of frequency characteristics.

b. Use of the magnet in the shape of a simple cylinder contributes to lowering of the cost of fabrication in comparison with that for the conventional electroacoustic transducers for which machining of the magnet is required.

c. Use of the magnet in the shape of a cylinder without any part thereof where magnetic force is lowered, such as a notch, enables the diaphragm to be provided with a uniform magnetic field, eliminating a risk of variation in sound quality due to deflection of a magnetic field.

d. As connection of the external terminals with the terminals of the coil can be made in the space formed underneath the magnet, miniaturized and low-profile models are fabricated as opposed to the conventional electroacoustic transducers wherein electrical connection is provided outside the casing.

The constitution, operation, and effect of the invention are described in the foregoing with reference to the embodiments, however, it is to be expressly understood that the electroacoustic transducer according to the invention is not limited to the scope of the embodiments described above, but includes all constitutions such as various constitutions and modifications which will become apparent to those skilled in the art upon making reference to the objects and embodiments of the invention.

What is claimed is:

1. An electroacoustic transducer that generates a static magnetic field and an alternating magnetic field, the latter field generated in response to applied electric signals, the fields exerting magnetic forces on a diaphragm made of a magnetic material so that the electric signals are converted into sound, said electroacoustic transducer comprising:

a casing;

a magnetic core disposed in the casing and supported on a base, the core located adjacent the diaphragm, so that a gap is provided between the core and the diaphragm;

a coil wound around the magnetic core and supported on the base for causing the alternating magnetic field to be generated by the electric signals and causing the alternating magnetic field to act on the diaphragm through the magnetic core;

a magnet creating the static field, the magnet being bee of contact and unsupported by the base, and having a vertical thickness between the dip and the base that is less than the height of the magnetic core, to form a space at a backside of the magnet.

2. An electroacoustic transducer according to claim 1 wherein external terminals for receiving the electrical signals and terminals of the coil are connected within the space.

3. An electroacoustic transducer according to claim 1 further comprising means for supporting the magnet integrally formed with the casing.

4. An electroacoustic transducer according to claim 1 wherein the diametrical thickness of the magnet is greater than its axial thickness.

5. An electroacoustic transducer according to claim 1 further comprising means for supporting the magnet separately formed from the casing.

* * * * *